United States Patent [19]

Paraskevas

[11] Patent Number: 4,879,892

[45] Date of Patent: Nov. 14, 1989

[54] DRAWING MACHINE FOR CONTINUOUS DRAWING OF ENDLESS WIRES OR TUBES

[75] Inventor: Elefterios Paraskevas, Aachen, Fed. Rep. of Germany

[73] Assignee: Kiehmaschinen GmbH, Solingen, Fed. Rep. of Germany

[21] Appl. No.: 241,426

[22] Filed: Sep. 7, 1988

[30] Foreign Application Priority Data

Sep. 7, 1987 [DE] Fed. Rep. of Germany ..... 3729892

[51] Int. Cl.[4] ..... B21C 1/28

[52] U.S. Cl. ..... 72/290; 226/165

[58] Field of Search ..... 72/290; 226/163–165, 226/162

[56] References Cited

U.S. PATENT DOCUMENTS

| | | | |
|---|---|---|---|
| 2,840,381 | 6/1958 | Mersek | 226/166 |
| 3,138,243 | 6/1964 | Oakley | 72/290 |
| 3,690,133 | 9/1972 | Hilgers | 72/290 |

*Primary Examiner*—Daniel C. Crane

*Attorney, Agent, or Firm*—Klein & Vibber

[57] ABSTRACT

A continuous drawing machine for drawing elongated material through a die has two drawing carriages each with one pair of jaws to grip the wire. The jaws are wedge-shaped and mounted on their rear side in oblique supports. Once in operation they are self-gripping. A linkage system, comprising an arm extending from each carriage and two cam curves on the machine-frame, controls the initial grip of the jaws on the wire. The two cam curves are formed by an oscillating tongue articulated on the machine frame next to the starting position of the carriage. The arm has a follower-roll that follows the first cam curve and thus clamps the wire. During the return of the carriage the tongue with the two cam curves thereon is pushed away by the follower-roll rolling or sliding with its face along the second cam curve. The tongue snaps back by means of a spring as soon as the follower-roll has passed and again offers the first cam curve to the follower-roll after the reversal of the carriage's moving direction. The linkage system is buffered by a torsion spring to avoid breakage. The jaws are forcibly opened by a third cam curve in case the automatic opening effect of the jaws is somehow jammed at the end of the working stroke.

10 Claims, 4 Drawing Sheets

DRAWING MACHINE FOR CONTINUOUS DRAWING OF ENDLESS WIRES OR TUBES

FIELD OF THE INVENTION

The invention relates to a continuous drawing machine for endless wires and the like material. The wires are drawn through a die mounted at one end of an elongated machine frame. At least two drawing carriages are provided on the machine frame, which alternately and continuously pull the wire through the die. Before the drawing operation the wire is usually wound up in a coil. To prepare it for drawing the wire is usually uncoiled, prestraightened and sand- or steel-blasted in one line of machines. After the drawing process the wire is either coiled or cut to length and subject to a further straightening operation.

BACKGROUND OF THE INVENTION

The alternating movement of drawing carriages requires exactly controlling the path over which the wire travels through the drawing machine. It becomes obvious that the carriages need different speeds during the working phase and their return movement to assure constant and continuous advance of the wire throughout its whole length with overlapping phases of traction of the two drawing carriages. To guarantee a constant drawing speed, each drawing carriage first has to be accelerated in the drawing direction before its clamping jaws may grip the wire and take over the tractive force. To make sure, that the wire is drawn through the die at a constant speed, the working phases of both carriages slightly overlap. The grip of the pair of clamping jaws has to be released again, before the carriage reaches the end of its path. For the rest of the path the carriage has to be slowed down and thereafter brought back to its starting position. An exact timing for these different functions is necessary to extend the working range of the path of each carriage to the maximum possible.

Wedge-shaped clamping jaws are often used to grip the wire. They are slideably mounted in forwardly diverging guideways. To reduce the friction between the guideways and the jaws, the latter usually are backed up by a series of rollers on the guideways. The jaws are moved axially in their guideways to clamp the wire radially. Once the wire is gripped by the jaws and is kept under axial force the gripping mechanism needs no further actuation and clamps the wire as long as the axial force is exerted on the wire. The clamping mechanism opens as soon as the axial force is switched off. A continuous drawing machine is known from the German published patent application No. 28 06 380, having two drawing carriages with wedge-shaped clamping jaws. To control the movement of the clamping jaws a shaft is connected to the main drive of the drawing machine and bears a cam for each carriage. The shaft is rotatably supported on the machine frame. The cams being located in close proximity to the starting position of each carriage. An arm with a cam follower is rotatably mounted on each carriage, the cam getting in touch with the lever as soon as the carriage leaves its starting position, thereby axially moving the jaws and clamping the wire. That is the moment, when the carriage under consideration has finished its acceleration and the other carriage begins to slow down. In this instance the carriage under consideration takes over the tractive force needed for the drawing operation and the automatic clamping effect is achieved in the carriage under consideration.

The immense precision and the speed of actuating the clamping jaws is not sufficient in the known drawing machine because of the fact, that the lever protruding from the carriage and controlling the clamping action of the jaws, may not touch the cam, when approaching the starting position of the carriage, i.e. on the return of the carriage but only when it moves in the drawing direction in the aforementioned instant, when the drawing carriage has to take over the tracting force. So the stationary cam has to overtake the starting carriage and the lever mounted thereon. This control mechanism is very expensive and difficult to manufacture and to adjust.

OBJECTS OF THE INVENTION

It is therefore an object of the present invention to provide a control mechanism for the clamping jaws of a continuation drawing machine that is simple in design and easy to adjust and which overcomes the aforedescribed disadvantages.

Another object is to provide an arrangement for a control mechanism for a continuous drawing machine, wherein each carriage has its movement controlled by a cam on a drum which rotates about an axis of rotation parallel to the direction in which the wire is drawn, the rotatably driven shaft, on which the drum is fixed, being mounted inside the framework of the drawing machine and underneath the drawing carriages.

SUMMARY OF THE INVENTION

A Drawing machine according to the invention has a machine frame with a drawing die mounted thereon, at least one drawing carriage and drive means for axial displacement thereof; guideways for at least one drawing carriage; at least two clamping jaws on each drawing carriage, the clamping jaws being displaceable towards the workpiece. The drawing machine according to the invention further comprises an arm, projecting from each carriage, the arm cooperating with the machine frame by means of a first cam curve arranged next to the starting position of the carriage.

According to the invention the drawing machine comprises two cam curves to control the clamping movement of the jaws. The first cam curve is followed by the arm during the initialization of the working stroke of the carriage bringing the jaws into clamping engagement with the wire and the second curve is followed by the arm at the end of the return stroke. No tubes, no cables and no hoses interconnecting the frame and the carriage are required to control the clamping mechanism.

The first and second cam curves of the present invention are arranged on adjacent sides of a cam body; the adjacent sides being arranged at approximately right angles to each other.

In accordance with further features of this invention the cam body is arranged at the free end of a tongue, the arm and the tongue being movable relative to each other in a plane perpendicular to the plane in which the lever is oscillating to operate the clamping jaws. The aforementioned tongue is articulated on the frame of the drawing machine and a cam follower-roll is arranged at the free end of the arm. The invention furthermore proposes to arrange the follower-roll to cooperate with both cam curves; one cam curve being arranged to cooperate with the circumferential surface of the roller, the other cam curve with the face of the roller.

The operation of the tongue and of the arm are arranged in planes perpendicular to each other. The tongue is biased against a stop by spring means and the tongue which is in touch with the stop protrudes into the path of the cam follower-roll. The tongue is pushed away by the returning carriage and clashes back as soon as the carriage with the arm on it has passed the tongue and reached its starting position at the upstream end of the carriage-path.

The invention furthermore proposes unlocking means for the clamping jaws, cooperating with the arm. The unlocking means are arranged in proximity to the downstream end of the carriage path. This is to assure that the jaws are open, when the carriage begins to slow down. Preferably a clamping mechanism is foreseen, that opens the jaws automatically as soon as the drawing force is taken over by the other drawing carriage. The unlocking means make sure that the jaws are opened, if irregular working conditions hinder the jaws from releasing the grip. In a preferred embodiment of the invention the unlocking means comprise an unlocking cam controlling the arm shortly before the end of the working path of the carriage to open the jaws.

BRIEF DESCRIPTION OF THE DRAWINGS

The above and other features and advantages will become more readily apparent from the following, reference being made to the accompanying drawing, in which.

SPECIFIC DESCRIPTION

Figure 1:
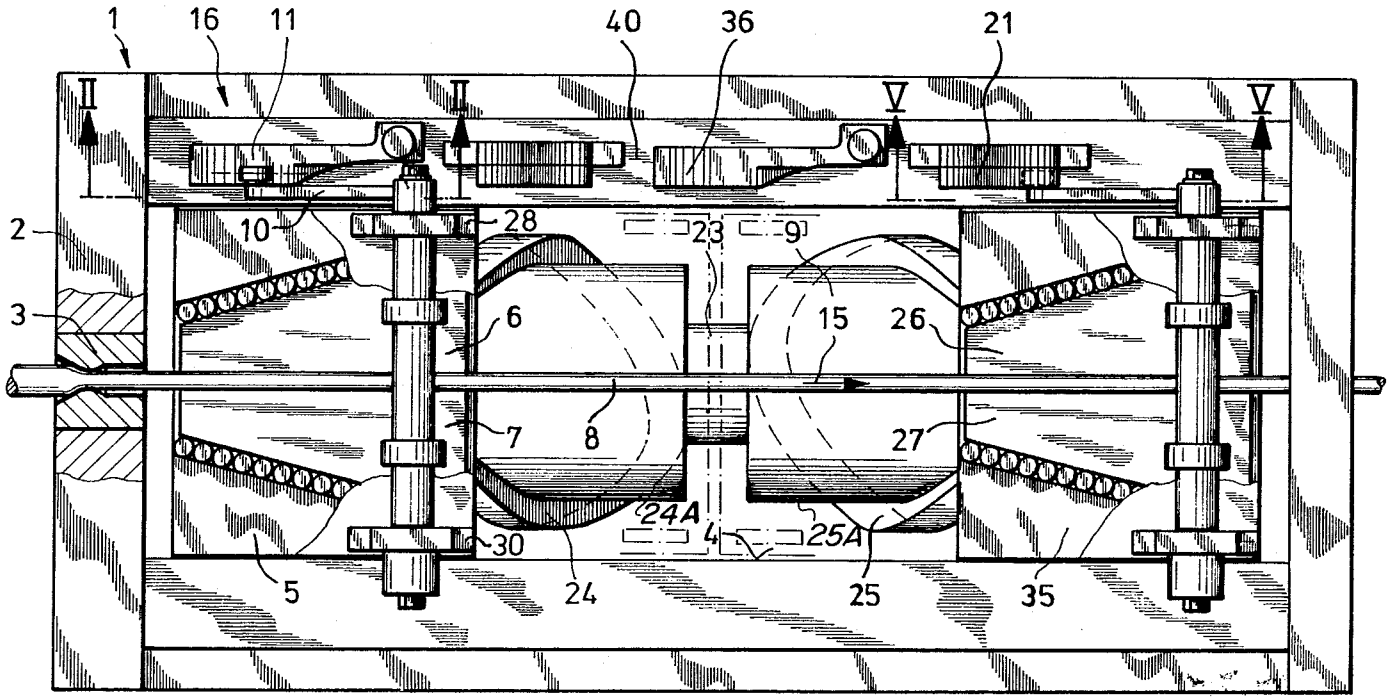
FIG. 1 is a top view of the drawing machine.

FIG. 1 shows a continuous drawing machine 1 comprising a frame 2, a drawing die 3 and two drawing carriages 5, 35, sliding in slideways 4, 40 on the frame 2 in the drawing direction 15. Drive 9 displaces the carriages 5 and 35 to and fro. The carriages are driven by means of a rotating shaft 23 supported in the frame 2. The shaft extends in the drawing direction 15. Two cam drums are concentrically attached to the shaft with cam curves 24, 25 on their circumference. The cam curves are obliquely located on the drums and approximately elliptical in shape. Underneath the bottom of each drawing carriage two rollers 24A and 25A are installed, engaging the cam curve on the drum below the path of the carriage. This type of drive mechanism is well known in the art and the left half of such drive mechanism is illustrated in FIG. 7.

The drawing carriages 5, 35 move under working conditions for the most part in opposite directions. As long as the carriage 5 draws the wire 8, the carriage 35 moves back and vice versa. In order to have a continuous drawing movement of the wire 8, the drawing phases of both drawing carriages must overlap for a minimum of time, e.g. a few milliseconds. During this time of overlapping the drawing force is taken over by the carriage just leaving its starting position.

Such a situation is illustrated in FIG. 1. The carriage 35 is next to its end of travel in the working direction and carriage 5 is close to its starting position. To arrange for taking over of the drawing force by carriage 5 its clamping jaws 6, 7 have to be closed, i.e. the clamping jaws must grip the wire 8. Closing of the clamping jaws 6, 7 is effected by cam curve 11 on a torque 16 and arm 10 protruding from the carriage 5 and following cam curve 11 by means of its cam follower roll 22 at its free end.

Figure 7:
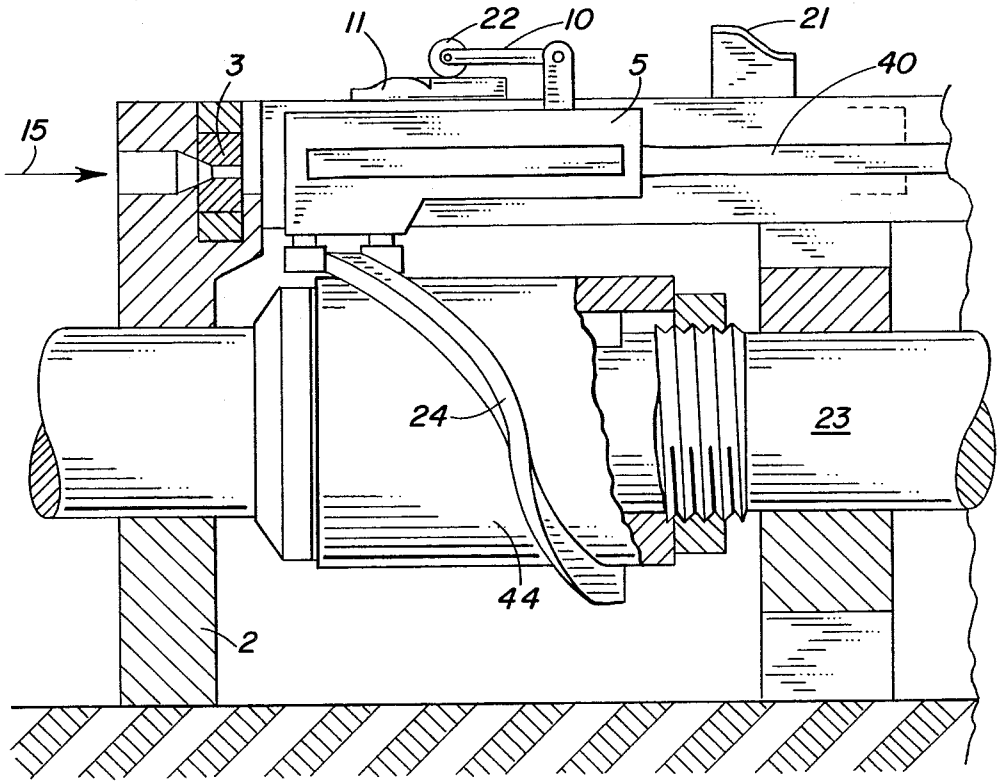
FIG. 7 is a side elevational view, partly in cross-section, illustrating the drive mechanism for the continuous drawing machine.

In FIG. 7 drive mechanism means for carriage 5 are shown in more detail. A die 3 is mounted on frame 2 and downstream of die 3 a carriage 5 is movable in guideways 40 in a horizontal direction (see arrow 15). Carriage 5 is moved to and fro between a starting position (shown in full lines) and an end position (shown in dash-dotted lines). Movement is effected by a conventional drive (not shown) for rotating shaft 23. Shaft 23 bears a cam drum 44 rigidly fixed thereon and a cam curve 24 formed on the perimeter of the cam drum. The cam curve 24 is designed as an endless edge surrounding the cam drum 44 on an inclined path in relation to the longitudinal axis of rotating shaft 23. Cam curve 24 serves as a guideway for two rollers 43, 46 on the bottom side of carriage 5. Upon rotation of shaft 23, an axial movement is imparted to carriage 5 following the path of that part of the cam curve 24 being on top of the cam drum 44.

The wedge-shaped clamping jaws 26, 27 release their grip on the wire 8 automatically as soon as the carriage 5 takes over the drawing force and the section of wire between the two carriages is no longer stressed. For security reasons the drawing machine according to the invention comprises unlocking means 21 releasing the grip of the clamping jaws 26, 27 of carriage 35 by force, in case the automatic opening of the jaws should have been hindered by any irregularities in the mechanic transferred from carriage 5 to carriage 35. To summarize, the grip on the workpiece is effected by cam curve 11 on the tongue 16 and—in an emergency case—the grip is released by unlocking means 21, whereas during regular operation of the drawing machine the jaws open automatically.

Design and operation of the two carriages are the same. The further description of the invention shall refer to the control of the jaws 6, 7 and 26, 27 by the tongues 16, 36. As illustrated in FIG. 1 a bridge is crossing each carriage and is mounted thereon by means of supports 28, 30. Arms 10, 20 extend from the bridges over the frame, from one slideway 4 to the other slideway 40.

MANNER OF OPERATION

Figure 2:
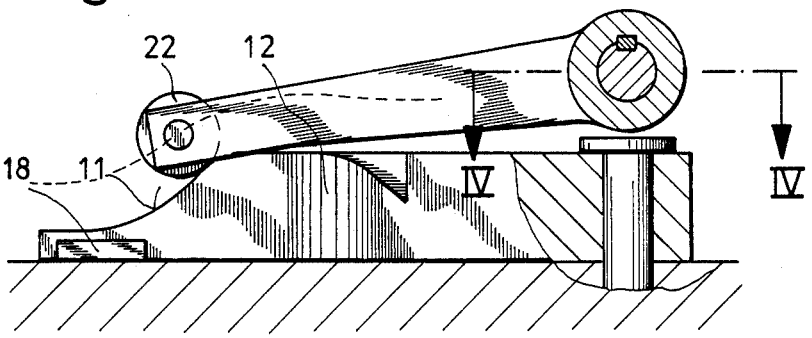
FIG. 2 is a partly sectional end view of the drawing machine of FIG. 1.
Figure 3:
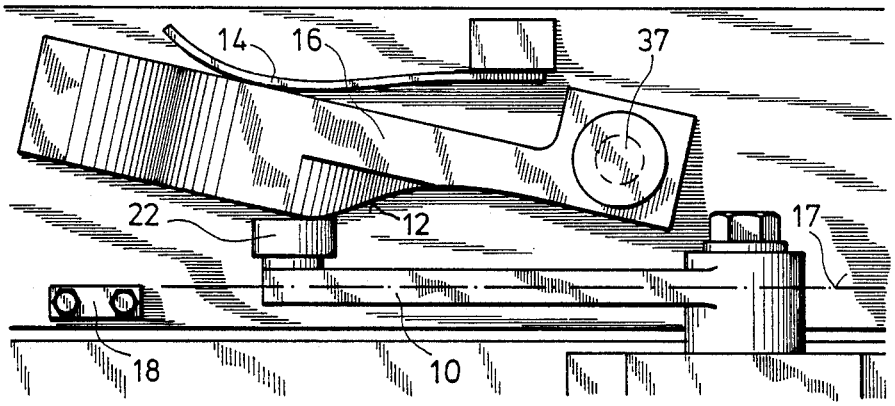
FIG. 3 is a top view of FIG. 2.
Figure 4:
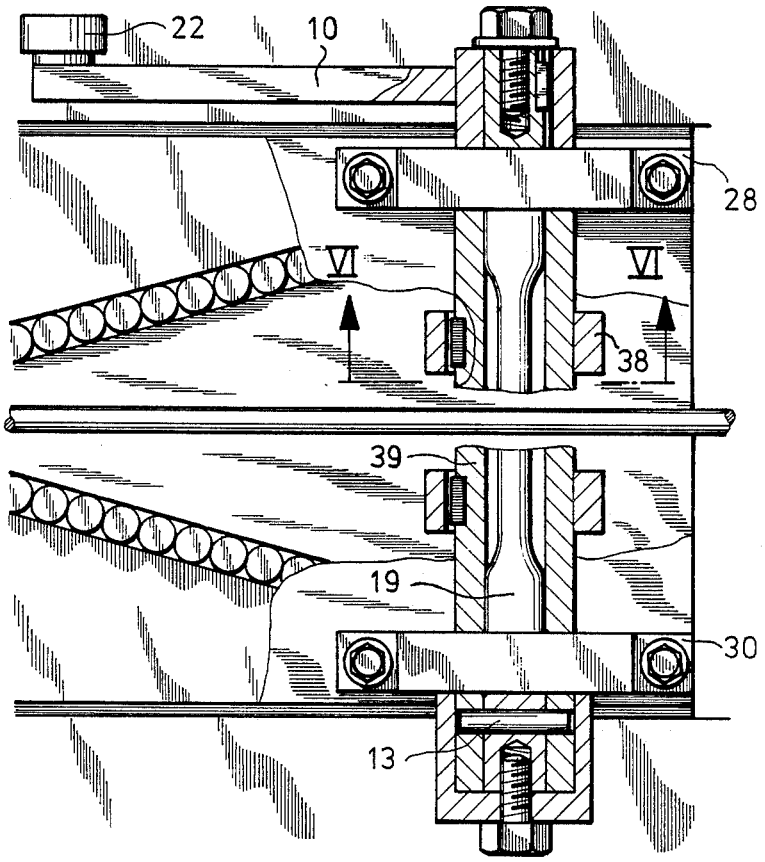
FIG. 4 is an end view along line IV—IV in FIG. 2.
Figure 6:
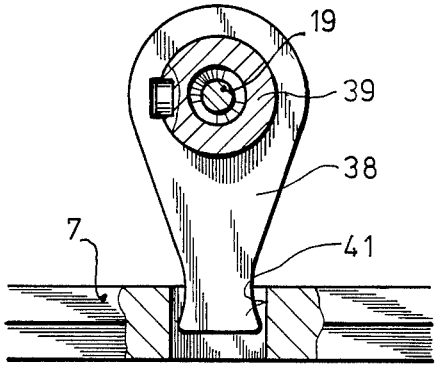
FIG. 6 is a sectional view along line VI—VI in FIG. 4.

Referring now to the FIGS. 2, 3 and 4 operation and control of the jaws 6 and 7 of carriage 5 shall now be explained in detail.

A rotatable tube 39 bridges the carriage 5, is supported by supports 28, 30 and has two clamping levers 38 mounted thereon, the latter facing downwards and extending into cavations 41 in the jaws 6, 7. A rotation of the tube 39 causes the jaws to move in or against the direction 15 of travel of the wire 8. The wedge-shape of the jaws and the corresponding oblique supports in the carriage 5 translate the axial movement of the jaws into a radial gripping action of the jaws on the wire 8. The self-gripping effect of the clamping mechanism is obtained as soon as the carriage 5 exerts traction on the wire at which point the carriage has moved relative to the jaws. At that stage the clamping levers 38 need no longer bias the jaws.

The clamping effect of the jaws 6, 7 or 26, 27 on the wire 8 is engendered by the frictional forces between the wire 8 and the pairs of jaws. When the wire is stressed between the clamping jaws and the die S, the frictional forces cause the inclined support surfaces to produce a clamping action via the carriage 5, 35. The carriage 5, 35 is movable relative to the pairs of clamping jaws 6, 7 and 26, 27 and vice versa. This pulling-in action of the jaws along the inclined support surfaces on the carriage increases the clamping forces and the thereby produced frictional forces until the required pulling force and frictional forces on the wire are balanced. In order to initiate the clamping and pulling process, the clamping levers 3B are selectively activated to bias the pairs of jaws 6, 7 or 26, 27 against the wire 8.

Tilting of the tube 39 and the clamping levers 38, mounted thereon is effected by means of arm 10 and the follower-roll 22 mounted on the free edge thereof. The working or tilting plane of the arm 10 is indicated at 17 (FIG. 3).

The movement of arm 10 is controlled by a cam curve 11, the latter being formed on a tongue 16 hinged at 37 on the frame 2. The tongue 16 is located in the path of the arm 10 with the follower-roll 22 at its free end. The movement of the path of follower-roll 22 rolling over cam curve 11 will cause the jaws 6, 7 to grip the wire 8. The movement of the follower-roll 22 over tongue 16 is illustrated by a broken line in FIGS. 1 and 3. The tongue 16 with cam curve 11 disposed on top surface extends only over the first part of the path of travel of the carriage 5. Moving over cam curve 11, the follower-roll 22 tilts arm 10, tube 39 and clamping levers 38. The jaws 6, 7 thereby move in opposite direction to the drawing direction to grip the wire 8.

The carriage 5 then draws the wire for approximately 1 yard through the drawing die. As soon as the carriage 5 approaches the end of the working stroke, traction is taken over by carriage 35 as the gripping action of the pair of 26, 27 takes over from the pair of jaws 6, 7, where said movement is at that point slower than the axial movement of the pair of jaws 26, 27. After the jaws 6, 7 have released their grip, carriage 5 returns to its starting position.

On the way back follower-roll 22 does not mount the cam curve 11 but pushes the tongue with the cam body and the cam curve 11 thereon aside (FIG. 3). This pushing aside takes place against the force of biasing means 14 (for example a leaf spring). The follower-roll 22 glides or rolls with its face along a second cam curve 12, disposed on the confronting side of the cam body, i.e. the tongue 16, that faces towards the arm. The cam curve 12 is similar to a leading edge. The tongue 16 thereby is rotated about its articulation 37 (see FIG. 3). As soon as the follower-roll 22 has passed the cam curve 11, the tongue 16 snaps back under the force of biasing means 14 until it hits the stop 18 on the frame, thereby positioning the cam curve 11 for the next operative cycle in the path or working plane 17 of the follower-roll 22 mounted on arm 10.

An important advantage of the invention is to be seen in the arrangement whereby snapping back of the tongue 16 with the cam curve 11 is more exactly timed than any electronic, hydraulic or pneumatic control could do. Furthermore the control of the jaws, i.e. gripping of the wire, can be effected at the very beginning of the advance of the carriage 5, without any of the usual delays associated with actuating cylinders, switches, etc. being necessary, nor is any clearance required before the arm 10 can be operated by the cam curve 11. The carriage 5 overtakes the cam curve 11 when accelerating for the working stroke. The aforementioned operation steps are repeated for each and every working stroke of the carriage 5.

To make the adjustment of the arm 10 more comfortable, the linkage system between the cam curve 11 and the jaws 6 and 7 comprises a torsion spring. The spring is formed as a torsion spring 19. The torsion spring 19 is interposed between the arm 10 and the tube 39 and is located inside the tube. The tube 39 is attached to one end of the torsion spring and the arm 10 is attached to the other end thereof.

Cam curve 11 is somewhat higher than the necessary axial movement of the jaws requires. The arm 10 goes on climbing the mountain of cam curve 11 even if the final position of the jaws relative to their backing supports in the carriage is already reached, i.e. the jaws have already gripped the wire. The excess movement of the arm 10 deforms torsion spring 19. Tube 39 and jaws 6 and 7 do not follow the remainder of the movement made by arm 10. This allows for larger tolerances of adjustment of the clamping mechanism and compensates for tolerances in diameter of the wire, as well as for wear of the jaws. A reliable clamping of the jaws is thereby achieved.

Figure 5:
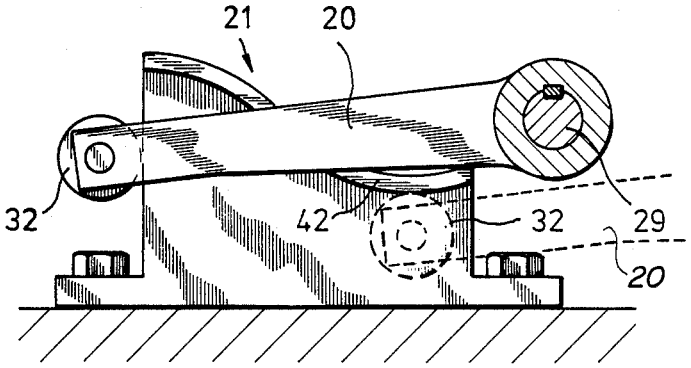
FIG. 5, is a view along line V—V in FIG. 1.

To release the grip of the clamping jaws 26, 27 at the end of the working stroke as illustrated in FIG. 1, FIG. 5 shows unlocking means 21 which forcibly open the jaws in case their grip has not been released automatically. At the end of the working stroke of carriage 35 arm 20 passes cam curve 42 mounted on the frame 2 (FIG. 1), the cam curve 42 being formed on the underside of an appropriate support. Under normal working conditions, the grip of the jaws has been released automatically during that phase of the working cycle and arm 20 is on a lower level indicated at 32 even at the moment when it enters the range of cam curve 42, i.e. the follower-roll 32 does not get in touch with the cam curve. If the backing surfaces of the jaws 26, 27 are worn and if wires with very small diameter are drawn, it happens that the jaws do not open automatically. In such a case, follower-roll 32 arrives as shown in broken line in FIG. 5 and is biased downwards in the process of passing cam curve 42, as demonstrated in FIG. 5. This forcibly opens the jaws 26, 27. The opening movement of the jaws is transmitted from arm 20 to the clamping levers 38 and the members linked with them, via the torsion spring 19. This avoids breakage of the control mechanism if something has got jammed in the linkage system of the control mechanism for the jaws.

On its way back the follower-roll 32 passes the cam curve 42 without touching it, because the jaws 26, 27 are already in their open position.

While a specific embodiment of the invention has been shown and described in detail to illustrate the application of the principles of the invention, it will be understood that the invention may be embodied otherwise without departing from such principles.

We claim:

1. A continuous drawing machine for longitudinally drawing a workpiece comprising: a machine frame with a drawing die mounted thereon, two drawing carriages and drive means for axial displacement thereof; an arm projecting from each carriage; guideways on said machine frame for said drawing carriages on which each of said carriages is movably mounted; at least one pair of clamping jaws on each drawing carriage, the clamping jaws being displaceable towards the workpiece by means of said arm; a first cam curve mounted on said machine frame; the arm cooperating with the machine frame by means of said first cam curve located next to the starting position of working stroke of the carriage; and a second arm curve mounted on said machine frame, said first and second cam curves being separate from said drive means, said second cam curve cooperating with the arm at the end of the return stroke; the arm actuating the clamping jaws to clamp said workpiece upon cooperation with the first cam curve.

2. The continuous drawing machine defined in claim 1, wherein the first and second cam curves are arranged on adjacent sides of a cam body, the adjacent sides being arranged at approximately right angles to each other.

3. The continuous drawing machine defined in claim 2, wherein the cam body is arranged at the free end of a tongue.

4. The continuous drawing machine defined in claim 3, wherein the arm and the tongue being movable relative to each other in a plane perpendicular to the plane in which the lever is oscillating to operate the clamping jaws.

5. The continuous drawing machine defined in claim 3, wherein the tongue is articulated on the frame of the drawing machine and a cam follower-roll is arranged at the free end of the arm to follow the cam curves on the tongue.

6. The continuous drawing machine defined in claim 3, wherein the follower-roll is arranged to cooperate with both cam curves; one cam curve being arranged to cooperate with the circumferential surface of the roller, the other cam curve with the face of the roller.

7. The continuous drawing machine defined in claim 4, wherein the operation of the tongue and of the arm are arranged in planes perpendicular to each other.

8. The continuous drawing machine defined in claim 7, wherein biasing means urge the tongue against a stop and the tongue, in touch with the stop, protrudes into the operative path of the cam follower-roll.

9. The continuous drawing machine defined in claim 1, including unlocking means for the clamping jaws cooperating with the arm, the unlocking means being arranged in proximity to the downstream end of the carriage-path.

10. The continuous drawing machine defined in claim 9, wherein the unlocking means comprise an unlocking cam; said carriage reciprocally moving between an upstream and a downstream end of an operative path; said unlocking means being located next to the downstream end of the carriage-path and cooperating with the arm, thereby controlling the position of the arm and opening the jaws.

* * * * *